US012392498B2

(12) United States Patent
Kordit et al.

(10) Patent No.: US 12,392,498 B2
(45) Date of Patent: Aug. 19, 2025

(54) FOOD COOKING STOVE

(71) Applicants: Evsey Avrumovich Kordit, Samara (RU); Petr Evseevich Kordit, Samara (RU); Aleksandr Petrovich Kordit, Samara (RU)

(72) Inventors: Evsey Avrumovich Kordit, Samara (RU); Petr Evseevich Kordit, Samara (RU); Aleksandr Petrovich Kordit, Samara (RU)

( * ) Notice: Subject to any disclaimer, the term of this patent is extended or adjusted under 35 U.S.C. 154(b) by 484 days.

(21) Appl. No.: 17/874,455

(22) Filed: Jul. 27, 2022

(65) Prior Publication Data

US 2023/0073784 A1 Mar. 9, 2023

(30) Foreign Application Priority Data

Sep. 6, 2021 (RU) ..... RU2021126175

(51) Int. Cl.
*F24C 15/00* (2006.01)
*F24C 3/00* (2006.01)
*F24C 15/32* (2006.01)

(52) U.S. Cl.
CPC ..... *F24C 15/001* (2013.01); *F24C 3/002* (2013.01); *F24C 15/32* (2013.01)

(58) Field of Classification Search
CPC ..... F24C 15/001; F24C 3/002; F24C 3/004; F24C 3/008; F24C 15/32; F24C 15/002;
(Continued)

(56) References Cited

U.S. PATENT DOCUMENTS

2004/0011350 A1* 1/2004 Dowst ..... A47J 36/26 126/344
2014/0311475 A1* 10/2014 Dowst ..... A47J 36/26 126/25 R (Continued)

FOREIGN PATENT DOCUMENTS

CN 202109547 U * 1/2012
CN 106885271 A * 6/2017

(Continued)

OTHER PUBLICATIONS

Russian Search Report issued Feb. 22, 2022, in Russian Patent Application No. 2021126175 (with English translation), 4 pages.

*Primary Examiner* — Jorge A Pereiro
(74) *Attorney, Agent, or Firm* — Oblon, McClelland, Maier & Neustadt, L.L.P.

(57) ABSTRACT

A food cooking stove, comprising a burner, a stovetop and a casing divided by a partition into a liquid transfer medium compartment and a combustion product compartment arranged under the stovetop and above the heat transfer medium compartment. The casing has provided in it a duct extending inside the heat transfer medium compartment through a partition between the compartments and the heat transfer medium compartment outer wall. The burner is coupled to a pipe arranged in the duct with a clearance to the duct walls and extending into the combustion product compartment. Combustion products are withdrawn from the compartment under the stovetop via a pipe extending inside the heat transfer medium compartment and tapped into the partition between the compartments and the wall of the heat transfer medium compartment.

8 Claims, 2 Drawing Sheets

(58) Field of Classification Search
CPC . F24C 15/34; F24C 13/00; A47J 36/26; A47J 27/022; B60P 3/2057; F24B 9/003; F24B 9/006
USPC ..... 126/39 H
See application file for complete search history.

(56) References Cited

U.S. PATENT DOCUMENTS

| | | | | |
|---|---|---|---|---|
| 2018/0023816 | A1* | 1/2018 | Kim | A47J 36/26 126/38 |
| 2020/0093328 | A1* | 3/2020 | Gaudyn | A47J 27/002 |

FOREIGN PATENT DOCUMENTS

| | | | | |
|---|---|---|---|---|
| DE | 33 07 342 | A1 | 9/1984 | |
| GB | 544762 | A * | 4/1942 | |
| RU | 1778150 | A1 | 11/1992 | |
| RU | 2 143 647 | C1 | 12/1999 | |
| RU | 34 695 | U1 | 12/2003 | |
| SU | 506731 | A1 | 3/1976 | |
| WO | WO-2004027322 | A1 * | 4/2004 | F24C 13/00 |

* cited by examiner

FOOD COOKING STOVE

The present invention relates to stoves for use at a motor boat galley or in a recreational vehicle, i.e. a van that includes living quarters, which may be either configured as a trailer, or integrated with a self-propelled vehicle.

BACKGROUND OF THE INVENTION

One prior art food cooking stove is disclosed in Austrian Patent AT124800 dd. 10.10.1931, the stove comprising a stovetop heated with combustion products, a gas burner, a combustion chamber, a duct supplying combustion products to under the stovetop and a duct withdrawing the combustion products from under the stovetop and passing through a heat transfer medium reservoir. The stove according to this prior art solution has large overall dimensions making it unsuitable for installation, for example, in a recreational vehicle. Furthermore, neither any measures for safe operation of the stove, nor any thermal insulation of the stove components in direct proximity to the stovetop are provided.

Great Britain Patent GB544762 (FIG. 2) dd. 27.04.1942 discloses another prior art food cooking stove comprising a cylinder-shaped casing comprising a compartment to be filled with a heat-transfer liquid, a hot plate at one end of the casing, a duct withdrawing combustion products from under the hot plate, and a combustion chamber arranged within the casing, the compartment to be filled with a heat-transfer liquid surrounding the combustion chamber with an air space between them.

The stove according to this prior art solution also features large overall cross-sectional dimensions due to the presence of combustion chamber thermal insulation adjacent to the hot plate from underneath and the combustion product withdrawal duct directly adjacent to the hot plate.

Still another prior art food cooking stove disclosed in German Patent Application DE3307342 dd. 06.09.1984 comprises a combustion chamber arranged directly under a stovetop, a casing comprising a compartment to be filled with a heat-transfer liquid, which surrounds the combustion chamber, and a duct withdrawing combustion products from under the stovetop. In this way, thermal insulation of the stove components in direct proximity to the stovetop is provided.

The stove according to this prior art solution also features large overall cross-sectional dimensions due to thermal insulation of the combustion chamber adjacent to the stovetop from underneath. Furthermore, with the combustion product withdrawal duct located in direct proximity to the stovetop, no thermal insulation is provided for the combustion product withdrawal duct.

The claimed invention is aimed at overcoming the disadvantages of the prior art so as to provide for convenient and safe use of a food cooking stove in a confined space of a recreational vehicle or a motor boat galley.

SUMMARY OF THE INVENTION

A technical result achievable by the claimed invention consists in reducing the stove's overall cross-sectional dimensions while thermally insulating the stove components adjacent to the stovetop. The above technical result is achieved primarily by means of a heat transfer medium compartment arranged between the stovetop and a burner and by means of combustion product supply and withdrawal pipes to and from the stovetop extending through the heat transfer medium compartment.

Said technical results are provided by a food cooking stove, comprising a burner, a stovetop and a casing comprising a liquid heat transfer medium compartment, a combustion product compartment arranged under the stovetop and above the heat transfer medium compartment, and a duct extending inside the heat transfer medium compartment through a partition between the compartments and the heat transfer medium compartment outer wall. Further, the burner is coupled to a pipe arranged in the duct with a clearance to the duct walls and extending into the combustion product compartment, and combustion products are withdrawn from the compartment under the stovetop via at least one pipe extending inside the heat transfer medium compartment, which pipe may extended through a side wall or bottom of the heat transfer medium compartment.

The clearance between the pipe coupled to the burner and the duct walls is necessary to thermally insulate the pipe, is open on the side of the combustion product compartment, and is filled with combustion products.

Preferably, the burner is a vaporizing burner having liquid fuel and air inlets.

The steel casing may be of welded type and column-shaped or in particular cylinder-shaped, while the stovetop may be disk-shaped. The duct inside the heat transfer medium compartment may be comprised of a vertical and a pitched or horizontal stub pipes (pipe sections) tapped into the partition between the compartments and coupled to an opening in the heat transfer medium compartment outer wall, respectively, the wall being an outer cylindrical wall of the heat transfer medium compartment.

The heat transfer medium compartment may be provided with a heat transfer medium inlet and a heat transfer medium outlet at the compartment upper and lower portions, respectively, and configured for the heat transfer medium circulation through the compartment.

Said technical results are further provided by a food cooking stove, comprising: a burner (preferably, a vaporizing burner), a stovetop, and a casing comprising a liquid heat transfer medium compartment, a combustion product compartment arranged under the stovetop and above the heat transfer medium compartment, and a duct extending inside the heat transfer medium compartment through a partition between the compartments and the heat transfer medium compartment outer wall, the burner being coupled to the combustion product compartment via a pipe arranged in the duct with a clearance between them (the pipe and the duct) for withdrawing the combustion products from underneath the stovetop.

The stove may further comprise, for withdrawing the combustion products from the compartment under the stovetop, at least one pipe extending inside the heat transfer medium compartment through a partition between the compartments and an outer wall or bottom of the heat transfer medium compartment. The duct may be comprised of a vertical and a pitched (or horizontal) sections tapped into the partition between the compartments and coupled to an opening in the outer wall of the heat transfer medium compartment, respectively, while the vaporizing burner may be mounted on a flange of the pitched (or horizontal) section of the duct outside the heat transfer medium compartment, while the burner combustion chamber may be fitted into the pipe for supplying combustion products to the compartment under the stovetop, the combustion chamber cylindrical wall being coupled to the inner surface of said pipe which acts as the flame tube vaporizing burner.

For withdrawing the combustion products from the compartment under the stovetop via the clearance between the duct walls and the tube coupled to the burner, a stub pipe may be used, which is arranged outside the heat transfer medium compartment and tapped into a wall of the duct's pitched section between the compartment outer wall and the duct flange where the burner is mounted.

The casing may be column-shaped or in particular cylinder-shaped, while the stovetop may be configured in the form of a disk. The supply and exhaust combustion product flows in the compartment under the stovetop may be coupled via the clearance between the stovetop and a disk-shaped partition arranged under the stovetop with a clearance to the combustion product compartment walls, the pipe for supplying the combustion products to a region under the stovetop central portion being tapped into the disk-shaped partition for subsequent propagation of the combustion products between the stovetop and the disk-shaped partition into a region under the stovetop edge and withdrawal thereof from the compartment under the stovetop.

Heat transfer medium compartment may be provided with a heat transfer medium inlet and a heat transfer medium outlet at the compartment upper and lower portions, respectively, and configured for the heat transfer medium circulation through the compartment.

DESCRIPTION OF THE PREFERRED EMBODIMENTS

High temperature of stove structure components providing liquid or gaseous fuel combustion is typical to food cooking stoves using hot combustion products and having capped rings. However, the amount of heat transferred into food cooking vessels does not exceed 30%-50% of the total heat generated by a burner, while a temperature required for food cooking at a rate comparable to the rate of cooking on open flame rings may be as high as 600° C. Such temperature and associated heating of the stove outer surfaces are unacceptable from a safety standpoint. However, it is the temperature providing an acceptable food cooking rate (bringing 1 Liter of water to boil within 10 to 12 minutes).

On the other hand, it is wise to use such stoves to heat a heat transfer medium for further using it for space heating or water heating. Where there is no need for space heating or cold water heating, the stove components may be cooled, for example, at a watercraft, with flowing cold water.

Figure 1:
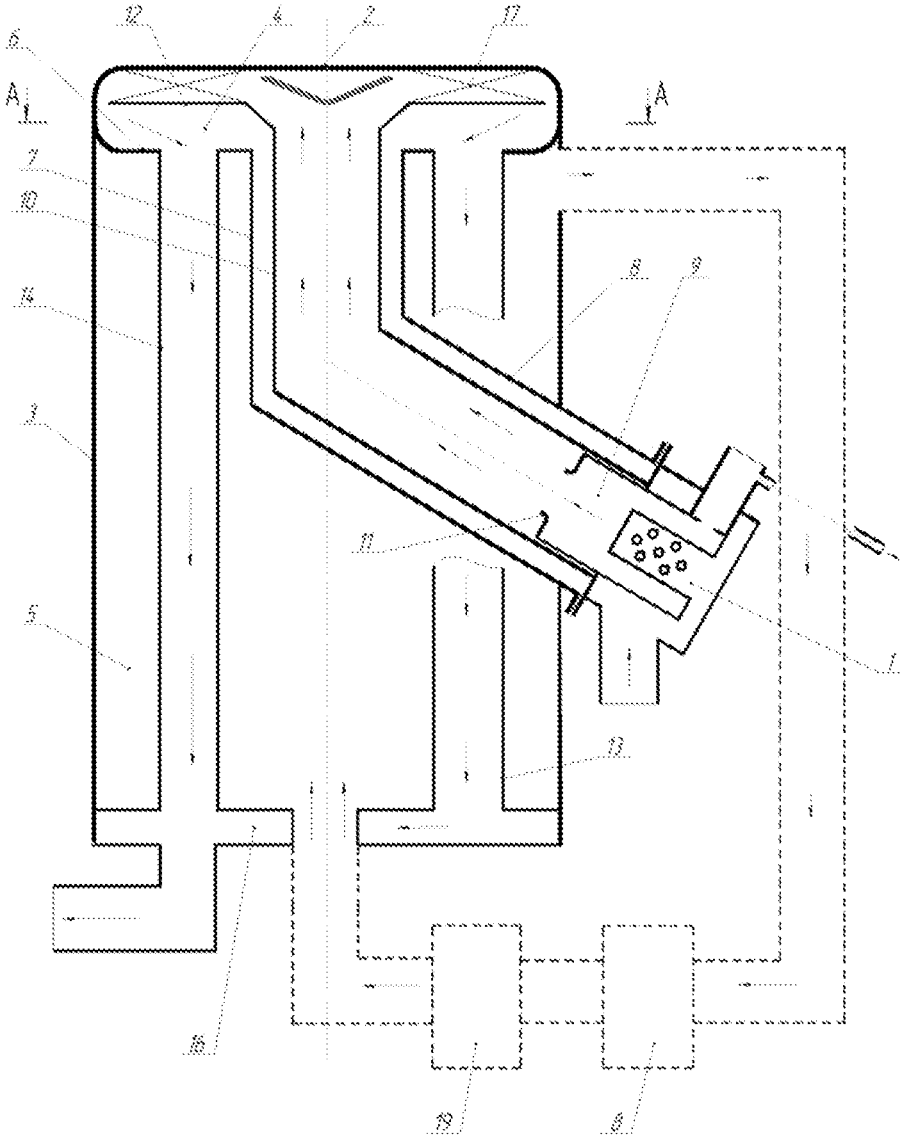
FIG. 1 shows a food cooking stove structure according to a first embodiment of the invention.
Figure 3:
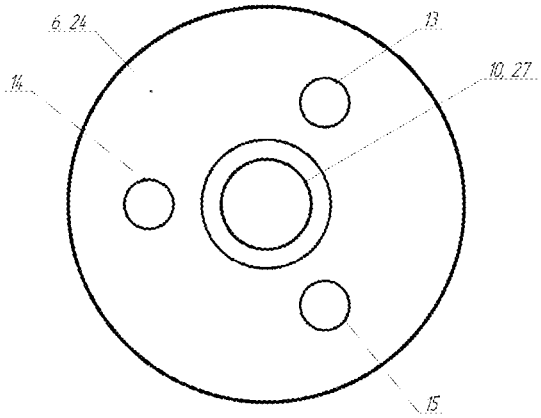
FIG. 3 shows a sectional view of a combustion product compartment, which is common for both embodiments of the invention and is located directly under the stovetop.

A food cooking stove, as shown in FIG. 1 and FIG. 3, comprises a vaporizing burner 1, a disk-shaped cast-iron stovetop 2 welded to a cylinder-shaped steel casing 3 comprising a stove-heating combustion product compartment 4 and a liquid heat transfer medium compartment 5 separated from each other by a horizontal partition 6, and a duct extending inside the heat transfer medium compartment 5 and comprised of a vertical pipe section 7 tapped into the partition 6 between he compartments and a pitched pipe section 8 extending through an outer wall of the heat transfer medium compartment 5, which is the casing's cylindrical wall. It is one of possible embodiments of the duct which does not have to be configured of pipe sections, but may instead be configured of a single pipe, either straight or curved.

The burner 1 having liquid fluid and air inlets is mounted on a flange of the duct's pitched pipe section 8. Herein, the burner 1 combustion chamber 9 is fitted into the pipe 10 also comprised of a vertical and a pitched portions arranged with a clearance to the walls of the respective vertical 7 and pitched 8 pipe sections of the duct and extending into the combustion product compartment 4. In the burner, a flammable mixture of liquid fuel and air fed thereto is produced and then ignited. The combustion chamber 9 is provided with a cylindrical wall, coupled to the pipe 10 inner surface, and a flame stabilizer 11.

The pipe 10, coupled to the burner and following the configuration of the duct's vertical 7 and pitched 8 pipe sections, is tapped into the disk-shaped partition 12 arranged under the stovetop 2 with a clearance to the combustion product compartment 4 walls for combustion product propagation between the stovetop 2 and the disk-shaped partition 12 into a region under the stovetop edge 2 and withdrawal thereof from the compartment 4 under the stovetop via the three pipes 13, 14 and 15 tapped into the partition 6 between the compartments 4 and 5, extending through the heat transfer medium compartment 5 and tapped into the compartment 5 bottom and an exhaust combustion product header 16 arranged under the heat transfer medium compartment 5 bottom for further removal from the stove. The clearance between the pipe 10 walls and the duct's pipe sections 7 and 8 is open in the compartment 4 under the stovetop 2 and filled with combustion products.

A flow swirler 17 is used to provide uniform heating of the stovetop 2 and is mounted in the combustion product compartment 4 between the stovetop 2 and the disk-shaped partition 12.

The heat transfer medium compartment 5 is provided with a heat transfer medium inlet and a heat transfer medium outlet in the compartment's upper and lower portions, respectively, and is connected to a pipeline comprising a dependent air heater 18 and a pump 19 for the heat transfer medium pumping.

Figure 2:
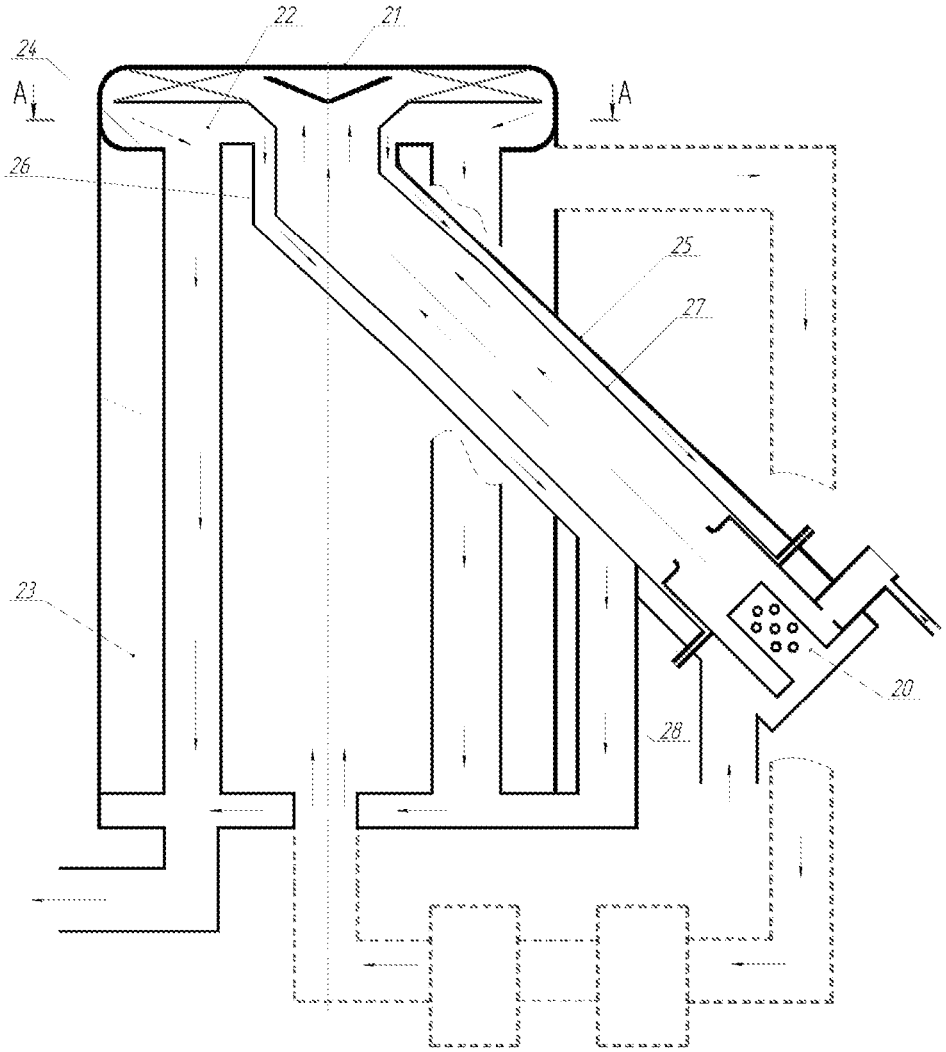
FIG. 2 shows a food cooking stove structure according to a second embodiment of the invention.

A food cooking stove, as shown in FIG. 2, similar to the stove in FIG. 1 and FIG. 3, includes a vaporizing burner 20, a combustion product-heated disk-shaped stovetop 21, a cylinder-shaped welded steel casing comprising a stovetop-heating combustion product compartment 22 and a liquid heat-transfer medium compartment 23 separated from each other by a horizontal partition 24, and a duct extending inside the heat transfer medium compartment 23 through the partition 24 and the heat transfer medium compartment outer wall, i.e. the casing's cylindrical wall.

The duct is configured of a pitched pipe section 25 extending through an outer wall of the heat transfer medium compartment, which is the casing's cylindrical wall, and directing the combustion product flow vertically upward via a ring-shaped member 26 tapped into the partition 24 between the compartments.

A vaporizing burner, similar to that in FIG. 1, is mounted on a flange of the duct's pitched pipe section 25 and is coupled to a pipe 27 arranged in the duct with a clearance to the duct's pipe section 25 and ring-shaped member 26 walls and extending to the combustion product compartment 22.

The structure shown in FIG. 2 is different from the structure shown in FIG. 1 in that the clearance provided between the pipe 27 and the walls of the pipe section 25 and the ring-shaped member 26 and open in the compartment 22 is used for withdrawing the combustion products from the compartment 22. To this end, a stub pipe 28 is tapped into the duct's pipe section 25 wall between the casing's cylindrical wall and the location where the burner is mounted. Via the stub pipe 28, combustion products from the compartment 22 under the stovetop are withdrawn through the clearance between the duct walls and the pipe 27 coupled to the burner into an exhaust combustion product header arranged under the heat transfer medium compartment 23 bottom.

As an alternative, combustion product withdrawal from the compartment 22 under the stovetop may be provided by arranging the stub pipe tapped into the duct's pipe 25 wall in the heat transfer medium compartment such that it respectively passes first through the heat transfer medium compartment and then is tapped into the exhaust combustion product header.

Furthermore, for withdrawing the combustion products from the compartment under the stovetop, use is also made, in the manner similar to that in the structure of FIG. 1, of three pipes tapped into the partition 24 between the compartments, extending through the heat transfer medium compartment and tapped into the exhaust combustion product header.

Advantages achieved by using the clearance between the duct walls and the pipe coupled to the burner to withdraw combustion products are not limited to a more compact structure or more intensive heating of the heat transfer medium. The exhaust combustion products are used also to cool the pipe coupled to the burner, thus extending its service life and the stove's operational life.

What is claimed is:

1. A food cooking stove, comprising: a burner, and a cylindrical casing, wherein the cylindrical casing comprises:

a stovetop that is the upper base of the cylindrical case;

a horizontal partition separating the cylindrical case into a combustion product compartment arranged under the stovetop, and a heat transfer medium compartment, side walls of both compartments are parts of a cylindrical wall of the case;

a pipe that removes the combustion products from the combustion products compartment that is tapped into the horizontal partition and the bottom of the heat transfer medium compartment; and a tubular duct arranged with an inclination inside the heat transfer medium compartment, tapped into the side wall of the heat transfer medium compartment and the horizontal partition, wherein the burner is coupled to a pipe arranged in the tubular duct with a clearance to the tubular duct walls for the removal of burning products from the burner to the combustion products compartment.

2. The stove of claim 1, wherein the tubular duct and the pipe are coupled with the burner and each comprises a vertical and a pitched branch pipes, the vertical branch pipe of the tubular duct is tapped into a horizontal partition between the compartments, and the inclined branch pipe of the tubular duct is tapped into the outer cylindrical wall of the heat transfer medium compartment.

3. The stove of claim 1, wherein the heat transfer medium compartment is provided with a heat transfer medium inlet and a heat transfer medium outlet at the compartment upper and lower portions, respectively, and is configured for the heat transfer medium circulation through the compartment.

4. A food cooking stove, comprising: a burner, and a cylindrical casing, wherein the cylindrical casing comprises:

a stovetop that is the upper base of the cylindrical case;

a horizontal partition separating the cylindrical case into a combustion product compartment arranged under the stovetop and a heat transfer medium compartment, and side walls of both compartments are parts of cylindrical wall of the case; and a tubular duct, arranged with an inclination inside the heat transfer medium compartment, tapped into the side wall of the heat transfer medium compartment and the horizontal partition, wherein the burner is coupled to a pipe arranged in the tubular duct with a clearance to the tubular duct walls to remove combustion products from the combustion products compartment through this clearance outside the side wall of the heat transfer medium compartment, and at the same time for the removal of burning products from the burner to the combustion products compartment.

5. The stove of claim 4, wherein it further includes, for withdrawing the combustion products from the compartment under the stovetop, at least one pipe that is tapped into the horizontal partition and the bottom of the heat transfer medium compartment.

6. The stove of claim 5, wherein the casing is cylinder-shaped, the supply and exhaust combustion product flows in the compartment under the stovetop are coupled via the clearance between the stovetop and a disk-shaped partition arranged under the stovetop with a clearance to the combustion product compartment walls, and the pipe for supplying the combustion products to a region under the stovetop central portion is tapped into the disk-shaped partition for subsequent propagation of the combustion products between the stovetop and the disk-shaped partition into a region under the stovetop edge and withdrawal thereof from the compartment under the stovetop.

7. The stove of claim 4, wherein the heat transfer medium compartment is provided with a heat transfer medium inlet and a heat transfer medium outlet at the compartment upper and lower portions, respectively, and is configured for the heat transfer medium circulation through the compartment.

8. The stove of claim 4, wherein the tubular duct and the pipe are coupled with the burner and each comprises a vertical and a pitched branch pipes, the vertical branch pipe of the tubular duct is tapped into a horizontal partition between the compartments, and the inclined branch pipe of the tubular duct is tapped into the outer cylindrical wall of the heat transfer medium compartment, wherein the vaporizing burner is mounted on a flange of the duct's pitched section outside the heat transfer medium compartment, wherein the burner combustion chamber is fitted into the pipe for supplying combustion products to the compartment under the stovetop, and wherein a stub pipe is tapped into the duct's pitched section wall between the casing cylindrical wall and the duct flange for withdrawing the combustion products from the compartment under the stovetop via the clearance between the duct walls and the pipe coupled to the burner.

* * * * *